United States Patent [19]

Pinard

[11] Patent Number: 4,901,912

[45] Date of Patent: Feb. 20, 1990

[54] NEWSPAPER CONTAINER

[76] Inventor: Gaston O. Pinard, 635, rue Roby, Drummondville, Quebec, Canada, J2C 5N3

[21] Appl. No.: 381,267

[22] Filed: Jul. 18, 1989

[51] Int. Cl.[4] ..... A47G 29/12

[52] U.S. Cl. ..... 232/1 C; 232/22; 211/88

[58] Field of Search ..... 232/1 C, 19, 20, 22, 232/43.4; 211/88

[56] References Cited

U.S. PATENT DOCUMENTS

| | | | |
|---|---|---|---|
| 2,142,901 | 1/1939 | Kellam | 232/1 C |
| 2,470,138 | 5/1949 | Browning | 232/22 |
| 4,494,690 | 1/1985 | Dupuis | 232/1 C X |
| 4,552,272 | 11/1985 | Field | 211/88 |
| 4,746,062 | 5/1988 | Bartylla | 232/1 C |

*Primary Examiner*—Robert W. Gibson, Jr.
*Attorney, Agent, or Firm*—Roland L. Morneau

[57] ABSTRACT

A mailbox charecterized by a tubular container having a flat back face adapted to rest against a door surrounded by a door jamb. The back face extends upwardly into a flat plate which hangs on a door knob. The container has an opening at one end which abuts against the door jamb for closing this one opening. The opening at the other end is provided with a unidirection gate for preventing withdrawal of letters and papers inside the container. Access to the inside of the container is reached when the door is opened.

6 Claims, 3 Drawing Sheets

NEWSPAPER CONTAINER

BACKGROUND OF THE INVENTION

1. Field of the invention:

This invention relates to a container and more particularly to a container which is mounted on the doorknob assembly of a door. The container is adapted to receive letters, newspapers or the like and hinder the unwanted removal of these articles from the container.

2. Prior art:

Most houses or dwellings are provided with letter boxes or letter apertures which can be used to receive letters or mail having a conventional format. However, these letters receiving apparatus are very seldom adapted to receive larger articles such as newspapers, magazines or the like.

Consequently, delivery of such articles can sometimes cause a problem since these articles are left outside the door where they can be damaged or removed.

The problem is even more acute in multiple occupancy dwellings such as apartment blocks or condominiums where mail flaps are sometimes not provided.

The following patents show some attempts to solve the problem.

Canadian Pat. No. 113,932 for example discloses an upright mailbox adapted to be mounted on a door with an inlet opening at the top which prevents mail from being withdrawn. The side of the box is open and is normally closed by being flush against the door jamb. The opening of the door allows mail to be removed from the side of the box.

This box however, is not adapted to receive large articles. Furthermore, its installation requires alteration of the door.

Canadian Pat. No. 1,203,787 discloses a box similar to the box disclosed in the above-mentioned patent. The box can be mounted on either edge of a door by a mounting clip. However, this mounting clip can only be used with doors having a given thickness. Furthermore, the box has an elaborate strucure, is bulky and costly to manufacture.

U.S. Pat. No. 2,470,138 discloses a mailbox attached to the door with an inlet at the top and an outlet at the bottom end. The outlet is actuated by a lever that is normally inaccessible, being abutted against the door jamb. When the door is opened, the level can be actuated to open the bottom of the box so that the mail can be removed. This box is unnecessarily complicated and its installation requires alteration of the door.

SUMMARY OF THE INVENTION

A container for receiving articles such as a mailbox is adapted to be hung on a door knob surrounded by a door jamb. The container is characterized by a hollow body having a back panel adapted to rest on the surface of the door. The body has a first opening for inserting the articles and a second opening for removing them from the body. A plate extending from the back panel is adapted to hook onto the door knob assembly in a position for closing the second opening against the door jamb.

Accordingly, the present invention relates to a box which enables newspapers or the like to safely remain at the door of apartments and other dwellings.

The present invention also relates to a box which can be installed without altering the door or its associated door jamb.

DETAILED DESCRIPTION OF THE INVENTION

Figure 1:
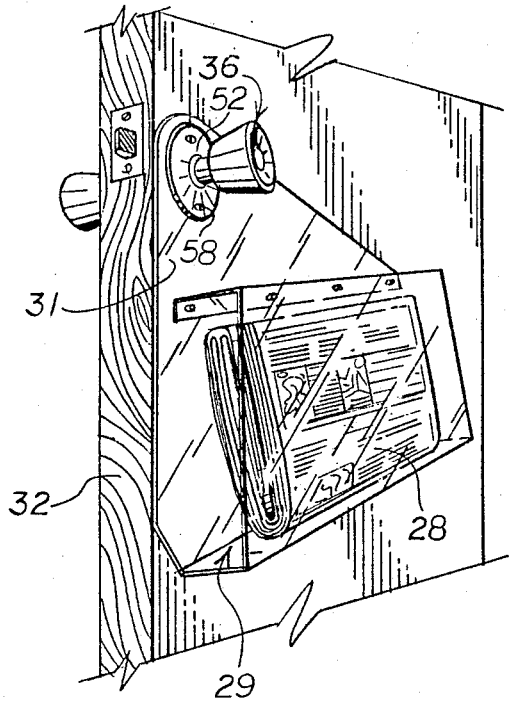
FIG. 1 is a perspective view of a container according to the present invention mounted on a door.

The container shown is generally designated by the reference numeral 10.

Figure 7:
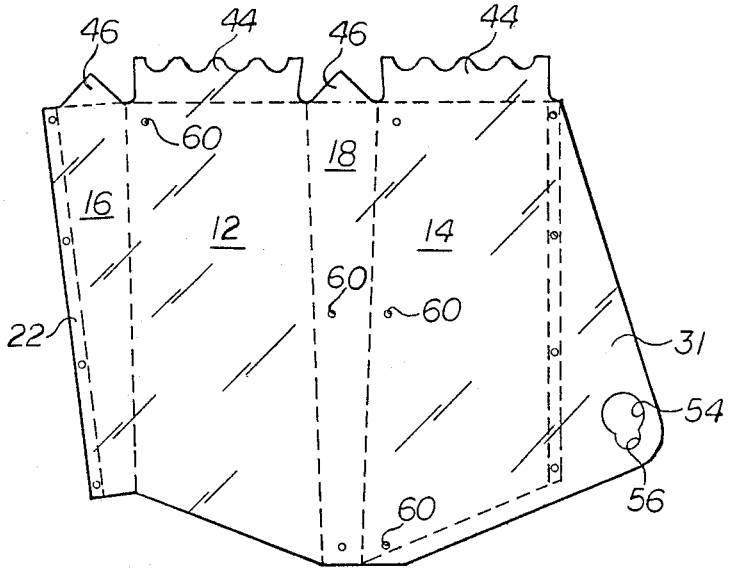
FIG. 7 is a view of a black adapted to be folded for forming the box.

In the preferred embodiment, the container 10 is formed from a single piece of sturdy plastic such as polycarbonate which is cut-out according to the pattern shown in FIG. 7.

Figure 2:
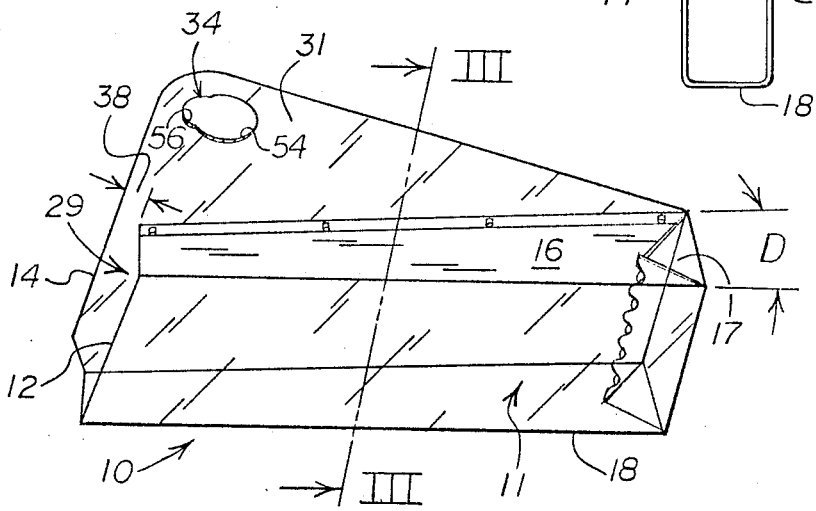
FIG. 2 is a top perspective view of the container.

As shown in FIG. 2, the container 10 has a main hollow body 11 comprising a front panel 12, a back panel 14, a top panel 16 and a bottom panel 18.

Figure 3:
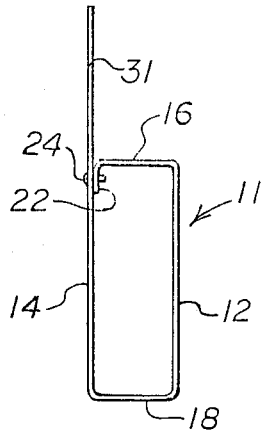
FIG. 3 is a cross-sectional view taken along line A—A of FIG. 2.

As shown in FIG. 3, a flange 22 extends downwardly from the material of the top panel 16 and lies against the back panel 14 The flange 22 is secured to the back panel 14 by attaching means such as rivets 24.

A first opening 26 adapted to allows insertion of an article 28 is provided at one extremity of the body 11. The first opening 26 includes means 27 to hinder removal of the article 28.

A second opening 29 adapted to abut against a door jamb 30 of a door 32 when the door 32 is closed, is provided at the other extremity of the body 11.

The second opening 29 can thus be closed by the door jamb 30, preventing removal of the article 28 from the hollow body 11.

A fixating plate 31 extends upwardly from the back panel 14 and in the same plane.. The fixating plate 31 is provided with an aperture 34 adapted to hook the plate 31 to a doorknob assembly 36 of a door 32.

Extending integrally from both the back panel 14 and the fixating plate 31 is an extension strip 38 adapted to abut against the inner portion 41 of the doorjamb when the door 32 is in a closed position.

In order to facilitate insertion of the article 28 into the hollow body 11 and to allow the article 28 once inserted to slide downwardly towards the second opening 29, the body 11 is inclined relative to an imaginary horizontal axis 42 with an angle C of approximately 22°.

As seen in FIG. 2, the front panel 12 is inclined relative to the back panel 14 so that an angle D of approximately 20° is formed between the front panel 12 and the back panel 14.

The main hollow body 11 longitudinally tapers making the first opening 26 wider than the second opening 29 for facilitating the insertion of article 28 inside the body 11.

Figure 4A:
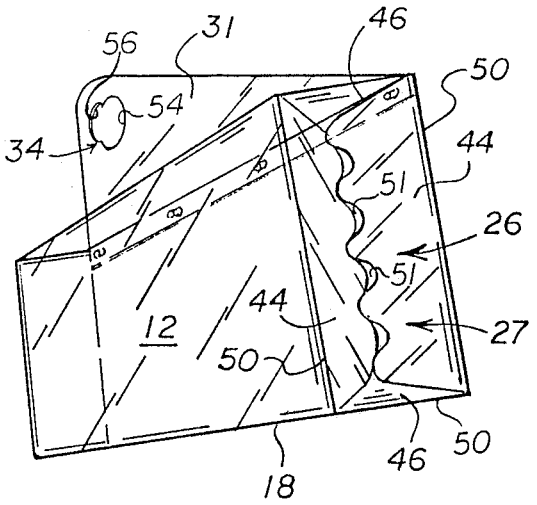
FIG. 4*a* is a side view of the container with the obstructing means in a closed position.
Figure 4B:
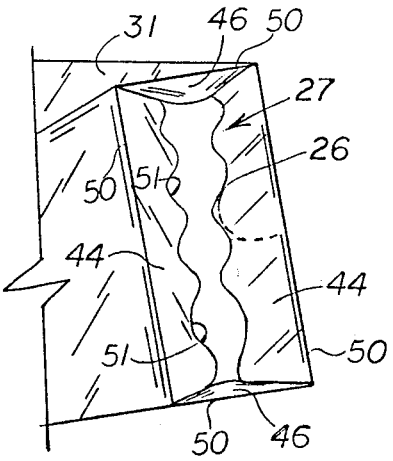
FIG. 4*b* is a detail side view of the container with the obstructing means in an opened position.

Referring now more specifically to FIGS. 4*a* and 4*b*, the means 27 to hinder removal of the article 28 comprises two obstruting flaps 44 and two abutting flaps 46.

One of the obstruting flaps 44 is formed integral with the front panel 12 while the other is formed integral with the back panel 14. One of the abutting flaps 46 is formed integral with the top panel 16 while the other is formed integral with the bottom panel 18.

Panels 44 and 46 originate from the edge 50 defining the first opening and are slanted inwards.

Since the obstruting flaps 44 are made of relatively resilient material such as polycarbonate, they can be pushed inwardly as illustrated in FIG. 4*b*, thus allowing the insertion of the article 28. The dimension of the flaps 44 is such that their inner edges abut against each other in an inwardly slanted direction.

However, the obstructing flaps 44 being slanted inwardly and the stiffness of the material preventing their outward bending, removal of article 28 through first opening 26 is hindered. The abutting flaps 46 further increase the difficulty of withdrawing the articles from the first opening 26 by abutting against the obstructing flaps 44.

The inner edge of the obstructing flaps 44 has, preferably, an ondulated shape. This configuration will allow a child or someonelse having caught his hand between the two obstructing flaps to slide the fingers in the apertures 51 and to remove them without causing injury.

Figure 5:
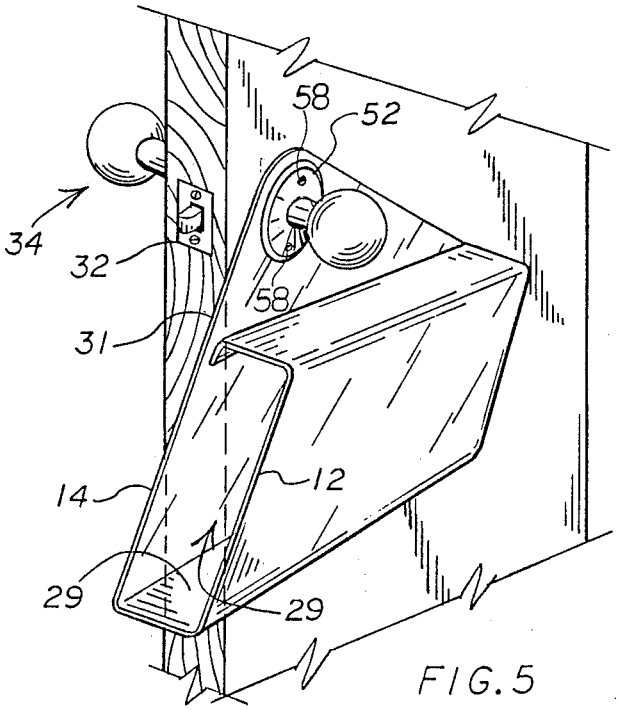
FIG. 5 is a view of the box in an interniate step of its installation.
Figure 6:
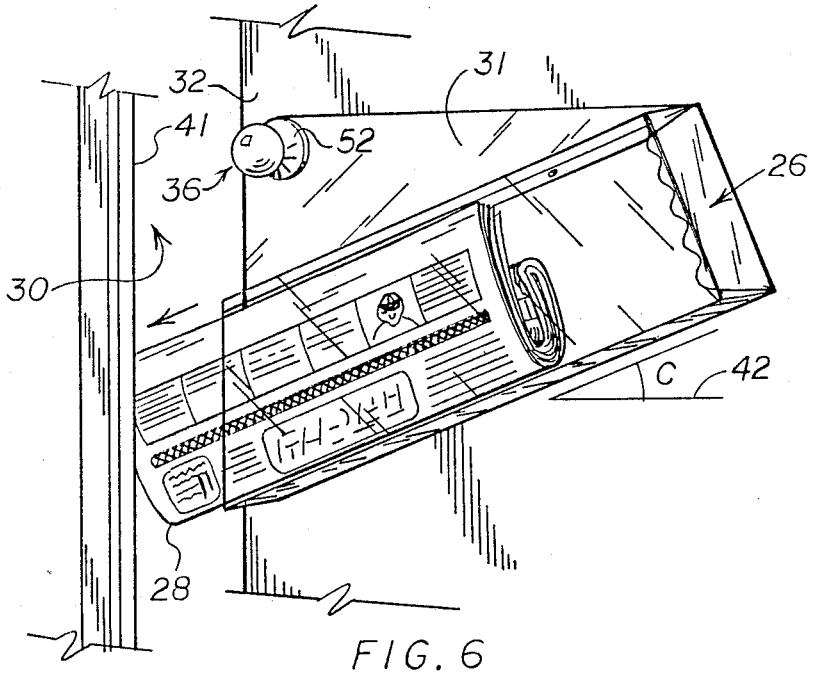
FIG. 6 is a perspective view of a container mounted on a door with the door slightly opened.

Referring now more specifically to FIG. 5, to install box 10 on the door 32, the user disassembles the doorknob assembly 36 in order to position the aperture 34 behind a doorknob ring 52 part of the doorknob assembly 36.

Nowadays, conventional doors are provided with doorknobs, which are spaced from the doorjamb by either 3½ inches or 4 inches.

The configuration of the aperture 34 which is delimited by two overlapping circles 54 and 56 allows the user to install the box to door having either one of these conventional settings. Once the aperture 34 is properly positioned on the doorknob assembly 36 the doorknob ring 52 can be put back in place. Since this doorknob ring is usually solidly attached to the door 32 by screws 58, the box will also be solidly attached to the door 32.

In order to further secure the box to the door 32 spots of adhesive compound such as silicone are added between the door 32 and the back plate 31.

The small apertures 60 shown in FIG. 7 are used during the folding operation to provide positioning means for the cut-out in the folding machine. During installation the spots of adhesive compound are preferably nested inside the small apertures 60 located on the back panel 14 before the latter is abutted against the door. Such adhesive does not damage the door and is sufficient to prevent rotation of the mailbox around the door knob assembly 36 or the folding of the fixating plate 31 when the body 11 is pulled away from the surface of the door 32.

I claim:

1. A container for articles adapted to be mounted on a door having a door knob assembly and surrounded by a door jamb, said container comprising:

a main hollow body for receiving articles, said main body having a back panel adapted to rest against a door, said body being provided with a first opening for inserting said articles into said body, and a second opening adapted to abut against said door jamb when said door is closed for closing said second opening and preventing removal of said articles from said container, a plate extending from said back panel of said main body, said plate having an aperture adapted to hook said plate on said door knob assembly and to retain said plate against said door and for closing the second opening against the door jamb.

2. A container for articles as recited in claim 1, wherein said first opening includes means for at least hindering removal of said articles from said main body through said first opening.

3. A container for articles as recited in claim 2, wherein said means for at least hindering removal of said articles from said main body through said first opening comprises two obstruting flaps and two abutting flaps peripherally extending from said body along the edges defining said first opening and slanting inwardly, whereby said flaps can be resiliently pushed inwardly to allow insertion of said articles but cannot be pulled outwardly to allow removal of said article.

4. A container for articles as recited in claim 1, wherein said main hollow body is longitudinally positioned at an angle in respect to the horizontal axis.

5. A container for articles as reseted in claim 1, comprising adhering means for holding said panel against said door.

6. A mailbox comprising an elongated tubular container having a flat back face adapted to rest against a door, said back face extending into a flat plate in the plane of said back face, said flat plate being provided with a performation adapted to fit around a door handle and be suspended therefrom, said elongated container having a first opening at one end provided with a contour defining a flat plane, said opening adapted to rest against a frame surrounding said door when the container is suspeneded from said handle, and means for releasably closing a second opening opposite said one end, for allowing unidirectional insertion of mail in said container.

* * * * *